US005232086A

United States Patent [19]

Montanari

[11] Patent Number: 5,232,086

[45] Date of Patent: Aug. 3, 1993

[54] CONTAINER DEVICE FOR A PLURALITY OF TOOTHED KEY BLADES PLACED SIDE BY SIDE, THAT MAY BE SELECTED AND PUSHED OUTSIDE ONE BY ONE

[76] Inventor: Pierluigi Montanari, Via Alpi Apuane, 70, Rome, Italy

[21] Appl. No.: 687,879

[22] PCT Filed: Dec. 19, 1989

[86] PCT No.: PCT/IT89/00081

§ 371 Date: Jun. 3, 1991

§ 102(e) Date: Jun. 3, 1991

[87] PCT Pub. No.: WO91/03185

PCT Pub. Date: Mar. 21, 1991

[30] Foreign Application Priority Data

Sep. 11, 1989 [IT] Italy ..... 48352 A/89

[51] Int. Cl.[5] ..... A45C 11/32

[52] U.S. Cl. ..... 206/37.2; 206/37.8; 70/456 R

[58] Field of Search ..... 206/37.1-37.8; 70/456 R

[56] References Cited

U.S. PATENT DOCUMENTS 2,602,320 7/1952 Lane ..... 206/37.2 X
2,640,347 6/1953 Majeski .
2,695,511 11/1954 Wing et al. .
4,307,590 12/1981 Friedland ..... 206/37.2 X
4,653,299 3/1987 Kim .

FOREIGN PATENT DOCUMENTS 2574264 6/1986 France ..... 206/37.4
372799 12/1963 Switzerland .

*Primary Examiner*—William I. Price
*Attorney, Agent, or Firm*—Beveridge, DeGrandi, Weilacher & Young

[57] ABSTRACT

A container for keys placed side-by-side. The container includes a sliding slide with a series of recesses for receiving the head of the keys. The slide is connected with a rack assembly which is in driving engagement with a pinion and a knurled wheel combination pivotably supported at one end of the container. The rack slides on a fixed smooth wall transversely extending within the container. The smooth wall includes a series of spaced cavities and a steel ball is positioned between the rack and smooth wall and is spring biased away from the rack so as to click into and out of position within the series of spaced cavities. The keys include notches for sliding on above and below transverse tracks. The tracks include a central notch. When a desired key is positioned within the central notch of each track, the key can be slid out through an opening in the end wall of the container by operation of a finger sliding tab having an internal pin which slides with the tab within a longitudinal slot. The pin is aligned with the central notches so as to extend into a recess formed in the key. Upon the sliding of the tab, the key is pushed out through the opening in the container. A spring biased plate with notched ends is positioned within an upper cover having a groove along which the tab slides and acts to releasably lock the key in either a retracted or an extended position. When the key is in the extended position, it can be used to unlock a lock while its head portion is retained in the container.

21 Claims, 1 Drawing Sheet

CONTAINER DEVICE FOR A PLURALITY OF TOOTHED KEY BLADES PLACED SIDE BY SIDE, THAT MAY BE SELECTED AND PUSHED OUTSIDE ONE BY ONE

FIELD OF THE INVENTION

The present invention concerns a container device for a plurality of toothed key blades placed side by side and which can be selected and pushed outside the container one by one. The container is carried about in a pocket or the like with minimum encumbrance. Also, the container is arranged such that various different keys may be selected very quickly.

BACKGROUND DISCUSSION

It is already well known that the less encumbering and most used keys are of the YALE kind, and that those keys, even being each very small and light, once assembled in a group of four or five or more, become a heavy and irregular encumbrance, being particularly inconvenient for carrying in the pockets of clothes.

SUMMARY OF THE INVENTION

It is therefore the aim of the present invention to provide a container device of minimum dimension, for the housing of seven or more YALE-keys. The container device is dimensioned and arranged such that individual keys can be selected and moved one by one into operationable position external to the housing.

BRIEF DESCRIPTION OF THE DRAWINGS

The present invention will be described in more detail hereinbelow according to the attached drawings in which a preferred embodiment of the object of the present invention is shown.

DETAILED DESCRIPTION OF THE PREFERRED EMBODIMENT(S)

Relating to the details of the figures, the device according to the present invention comprises a container, preferably in the shape of a rectangular parallelepiped, having on one of the sides transverse to the major axis, a small rectangular opening 4. By means of a sliding tab 5, sliding inside the cover along a small longitudinal opening 6, the toothed part of the key passes through the opening 4 when it is pushed out or taken back after use.

The choice of the key to be used is performed by counting the number of clicks created upon rotation of the knurled selection wheel 7, placed on the wall opposite to the opening for the keys outlet. Each click corresponds to the outlet position of a determined key. Thus, it is sufficient to memorize the various keys according to the clicks for finding them without having to look at them. Once the key has been chosen and the toothed blade pushed out of the container, said container is used as a handle for making the key turn in the lock.

Figure 6:
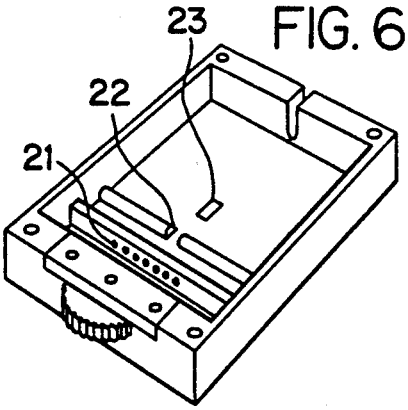
FIG. 6 shows, in detail, a possible selection and output mechanism for the keys.

Inside the container, a slide 8, movable transversely between the elongated sides of the container, may house seven or more blades in side-by-side contact with each other. In the transversal run, said slide 8 is guided by a track 9, interrupted at a center portion 22 (FIG. 6) for the width of a blade. Each key includes, at the top of the toothed part, a part of a guide 1, with two opposite grooves:

- the lower groove 2, i.e. the one obtained on the back of the blade resting on the plane of the slide, gets inserted on the guide track, repeating the shape of the transversal section. Through said groove, that gets hooked to the track, the keys follow the transverse movement of slide 8, becoming one in the same with slide 8.
- The upper groove 3 gets inserted, similarly, on a track 14. Track 14 is interrupted at its center like the preceding track and track 14 is formed on the internal wall of the cover. Pin 15 is provided within groove 16 for the dragging of the key, and is an extension of sliding tab 5. A key that is in correspondence with the pin is free from engagement with the upper track and with the guide track of the slide due to the central notch formed in the tracks. The centered key may therefore be slid or dragged by the pin of the sliding tab, until the toothed portion is fully extended external to the outlet opening.

Figure 7:
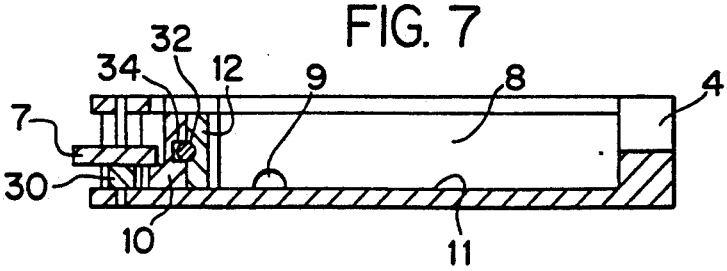
FIG. 7 shows a cross-sectional view taken along cross-section line VII—VII in FIG. 3.

Slide 8 is secured to rack 10 which, in turn, is engaged with a small pinion 30 (FIG. 7) connected (e.g., via a common shaft) to the small selection wheel 7 and, open rotation of wheel 7 and the attached pinion, rack 10 and slide 8 move inside a transversal groove with smooth walls 11. On the inner wall 12 seven or more spherical cavities 21 are placed side by side. The spherical cavities have equal distances between each other and within the spherical cavity a small steel ball 32 (FIG. 7) positioned between sliding rack 10 and fixed inner wall 12 gets engaged in succession, being pushed by a biasing spring (34, FIG. 7) housed inside the body of the rack 10. By means of the lateral movement of said rack 10 and of the connected slide 8, each following click of the small ball in the seats 21 corresponds to the outlet position of a different key.

Figure 1:
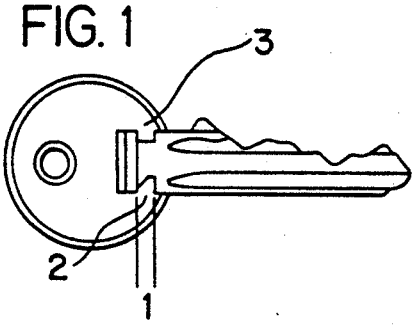
FIG. 1 shows a planar view of a of a YALE key that may be housed, together with a plurality of other keys, in the device according to the present invention.
Figure 2:
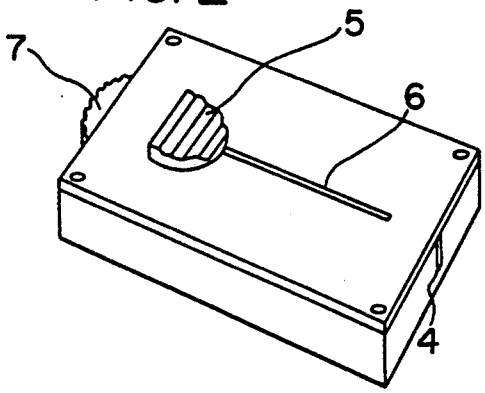
FIG. 2 shows a perspective view of the device according to the present invention.
Figure 3:
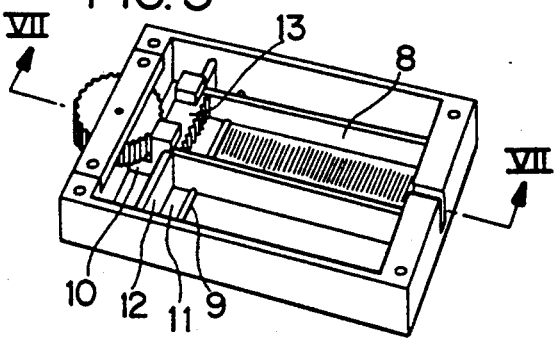
FIG. 3 shows a perspective view similar to that of FIG. 2 except with the cover removed to illustrate the internal details of the device.
Figure 4:
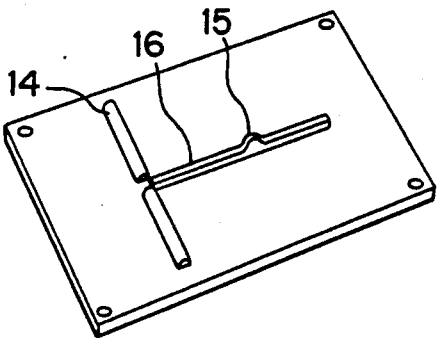
FIG. 4 shows the internal side of the cover.
Figure 5:
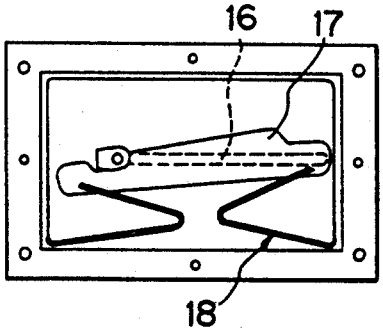
FIG. 5 shows the internal spring mechanism.

The dragging pin slides in a straight groove 16, obtained in the internal side of the container, and the length of the internal slide determines the amount the toothed portion of the key extends outward from the container when the curved head portion of the key abuts the rest portion of the interior end wall of the container in which the opening 4 is formed. The rest portion thus has the function of placing the profile of the blade inserted in the lock in a precise correspondence with the pins of the lock to be opened. In the container according to the present invention, the aforementioned rest consists of the same outlet wall with a small round relief along which the opening is formed. The pin 15, connected to a spring mechanism 18 in the interior of said cover, as shown in FIG. 5, is maintained by the same with a considerable resistance in the two positions of end run by means of a shaped plate. Thus, the transversal sliding of the slide 8 is always free, but once extended the slide is unable to move transversely and a higher resistance is imposed both at the externalmost and internalmost positions so as to avoid inadvertent release prior to use and retraction during use.

When all keys are inside said container, said mechanism has also the function of protecting the keys from the dust, because said plate 17, with the sliding tab at the run end, adheres to the internal plane of the cover, thus completely closing the groove for the sliding of the sliding tab 5.

For providing that the blades may not move and thus cause an irregular functioning in the inlet and output of the blades—particularly if they are of different lengths—each blade is kept in the correct position inside said slide 8 by a series of parallel vertical grooves 13, obtained in the back wall of the slide, in which the corresponding end part of the keys will get inserted.

It is possible to distinguish the blade coming out by a numeral being visualized through a little opening 23 formed in the side of the container opposite to the cover: the numerals corresponding to the keys are written on the sliding plane of the slide and appear, in succession, through the little opening.

The small pre-selection wheel may have, in an alternate embodiment, a vertical or a horizontal rotation axis and a friction ring between the body of the small wheel and an outer circumferential knurled crown. This latter arrangement prevents damage of the pinion gear teeth and rack teeth due to excessive forces which might occur upon overturning of the wheel the slide is at the end of its run.

A simplified and reduced variant of the device according to the present invention provides the direct control of slide 8 by means of a sliding tab, placed on the face opposite to the one of the blades, outlet, said sliding tab being of one piece with the block containing the ball and the spring.

In a further variant on the container's outlet wall a light point is provided for finding the lock. The light being lit when the key is out, because the feeding circuit gets closed by the passing of the key. The seats of the micro-lamp and the corresponding micro-battery are provided beside the groove to provide room for the passage of the blades.

I claim:

1. A container assembly for keys, comprising:

a container housing having a first end wall, a second end wall longitudinally spaced from the first end wall, a top cover and a bottom cover, said second end wall having an opening formed therein;

a slide which is dimensioned and arranged to store a plurality of keys in a side-by-side arrangement;

means for shifting said slide transversely within said container housing such that a desired key within said slide is shifted into alignment with said opening;

means for sliding the desired key in a longitudinal direction such that a portion of the desired key passes through said opening and out away from said container housing into an operational position.

2. A container assembly as recited in claim 1 wherein said container housing includes a fixed transversely extending guiding track with a notch formed therein between outer ends of said guiding track, said notch being transversely aligned with said opening, and said slide being dimensioned and arranged for sliding along said guiding track.

3. A container assembly as recited in claim 2 wherein said container housing includes a second transversely extending guiding track with said first guiding track extending off from said bottom cover and said second guiding track extending off from said top cover, said second guiding track including a notch which is transversely aligned within the notch in said first guiding track.

4. A container assembly as recited in claim 2 wherein said container housing further comprises a transversely extending inner wall longitudinally spaced from said guiding track, and said means for shifting including a rack assembly slidingly supported in a transverse direction on said inner wall, said slide being attached to said rack assembly, said means for shifting further including a wheel and pinion assembly rotatably supported by said housing such that said pinion is in driving engagement with said rack assembly and the wheel extends external to the container housing such that pivoting of said wheel causes pivoting of the pinion and transverse sliding of both said rack assembly and said slide.

5. A container assembly as recited in claim 1 wherein said housing further comprises a transversely extending inner wall, and said means for shifting includes a rack assembly slidingly supported in a transverse direction on said inner wall, said slide being attached to said rack assembly, said means for shifting further including a wheel and pinion assembly rotatably supported by said housing such that said pinion is in driving engagement with said rack assembly and the wheel extends external to the container housing such that pivoting of said wheel causes pivoting of the pinion and transverse sliding of both said rack assembly and said slide.

6. A container assembly as recited in claim 4 wherein said inner wall includes a series of spaced cavities, and said container assembly further comprising a ball and a biasing spring, said ball being positioned between said inner wall and a portion of said rack assembly, said portion of said rack assembly receiving said biasing spring so as to bias said ball away from said portion of said rack assembly and towards said inner wall such that transverse shifting of said slide forces said ball out of one of said cavities and into another of said cavities while creating a clicking noise.

7. A container assembly as recited in claim 6 wherein said means for sliding the desired key includes a sliding groove longitudinally extending along said top cover and a finger tab positioned above said sliding groove and a pin extending below said sliding groove, said pin being transversely aligned with the opening in said second end wall and adapted for extension within a recess formed in the desired key such that a sliding of said finger tab causes the pin to push the desired key out through the opening formed in said second end wall.

8. A container assembly as recited in claim 1 wherein said means for sliding the desired key includes a sliding groove longitudinally extending along said top cover and a finger tab positioned above said sliding groove and a pin extending below said sliding groove, said pin being transversely aligned with the opening in said second end wall and adapted for extension within a recess formed in the desired key such that a sliding of said finger tab causes the pin to push the desired key out through the opening formed in said second end wall.

9. A container assembly as recited in claim 8 further comprising locking means for releasably locking the desired key in said operational position.

10. A container assembly as recited in claim 9 wherein said locking means includes means for releasably locking the desired key in a retracted position.

11. A container assembly as recited in claim 10 wherein said releasably locking means includes a plate with notches formed in a contacting edge of said plate, and said locking means further comprising a spring assembly adapted to bias the contacting edge of said plate into contact with said pin.

12. A container assembly as recited in claim 10 wherein said top cover includes an internal hollow and said releasably locking means is retained within the internal hollow of said top cover.

13. A container assembly as recited in claim 1 further comprising locking means for releasably locking the desired key in said operational position.

14. A container assembly as recited in claim 13 wherein said locking means includes means for releasably locking the desired key in a retracted position.

15. A container assembly as recited in claim 14 wherein said releasable locking means includes a plate with notches formed in a contacting edge of said plate, and said locking means further comprising a spring assembly adapted to bias the contacting edge of said plate into contact with said pin.

16. A container assembly as recited in claim 15 wherein said top cover includes an internal hollow and said releasable locking means is retained within the internal hollow of said top cover.

17. A container assembly as recited in claim 1 wherein the opening in said second wall has an upper end below said top cover and a lower end above said bottom cover, and said opening being dimensioned and arranged so as to allow a sufficient portion of the desired key to extend out away from said second end wall so as to make the desired key functional with respect to a corresponding lock being locked or unlocked by the desired key.

18. A container assembly for keys, comprising:

a container housing having a first end wall, a second end wall longitudinally spaced from the first end wall, a top cover and a bottom cover, said second end wall having an opening formed therein between said top and bottom covers, said container housing including a transversely extending guiding track with an intermediate notch formed therein, said housing further including a transversely extending inner wall longitudinally spaced from said guiding track;

a slide with two longitudinally extending side walls for retaining the keys in a side-by-side relationship within said slide;

a rack assembly engaged with said slide and slidingly supported by said inner wall, said rack including a toothed surface;

a wheel and pinion assembly pivotably supported by said container housing, said pinion being in driving contact with the toothed surface of said rack assembly, said wheel having a portion extending out away from said container so as to facilitate finger rotation of said wheel such that the rotation of the wheel causes a rotation of said pinion which, in turn, causes said rack assembly to transversely shift together with said slide until a desired key is transversely aligned with both the notch in said guiding track and the opening in said second end wall; and means for longitudinally sliding the desired key out through the opening in said second end wall and into an operational position.

19. A container assembly as recited in claim 18, further comprising a ball and a biasing spring, and said inner wall including a series of transversely spaced cavities and said rack assembly including a surface juxtaposed with respect to said inner wall with said plurality of transversely spaced cavities, and said rack assembly supporting said biasing spring so as to bias said ball away from the surface of said rack assembly and toward said inner wall such that said ball is formed out of a first of said cavities and into a second of said cavities upon a transverse shifting of said slide while forming a clicking noise.

20. A container assembly as recited in claim 18 further comprising locking means for releasably locking the desired key in said operational position.

21. A container assembly for keys, comprising a container housing, having a first end wall, a second end wall longitudinally spaced from the first end wall, a top cover and a bottom cover, said second end wall having an opening formed therein between said top and bottom covers, and said top cover having a longitudinal groove formed therein;

a slide with two longitudinally extending side walls for retaining the keys in a side-by-side relationship within said slide;

means for transversely shifting said slide within said container housing such that a desired key within said slide is shifted into alignment with said opening;

a finger tab with attached pin, said finger tab being positioned above said groove and said pin being positioned below said groove and dimensioned so as to retain said finger tab slidingly locked with respect to said groove, said pin further being dimensioned and arranged so as to extend within a recess formed in the desired key such that a longitudinal shifting of said finger tab cause said desired key to slide out through the opening in said second end wall into an operational position, and said top cover supporting a releasable locking means for releasably locking the desired key into said operational position.

* * * * *